United States Patent [19]

Gilmore, Jr.

[11] 4,065,160

[45] Dec. 27, 1977

[54] ANTI-VANDALISM LOCK DEVICE FOR PANIC-TYPE DOORS

[76] Inventor: David D. Gilmore, Jr., 129 Miller Road, Kingwood, W. Va. 26537

[21] Appl. No.: 532,619

[22] Filed: Dec. 13, 1974

[51] Int. Cl.[2] ..... E05C 19/18

[52] U.S. Cl. ..... 292/92; 292/288

[58] Field of Search ..... 292/92, 93, 94, 1, 288, 292/289, 292, 293, 294; 70/92

[56] References Cited

U.S. PATENT DOCUMENTS

| | | | |
|---|---|---|---|
| 2,212,957 | 8/1940 | Spradling | 292/92 |
| 3,073,142 | 1/1963 | Stebbins | 70/92 |
| 3,383,130 | 5/1968 | DeAvila | 292/92 |

*Primary Examiner*—Robert L. Wolfe

*Attorney, Agent, or Firm*—Schwartz & Weinrieb

[57] ABSTRACT

An anti-vandalism lock device particularly adaptable for panic-type doors includes a substantially C-shaped housing having a substantially vertically disposed threaded bolt secured therein. The housing is adapted to be mounted upon one of the pivotable lever arms supporting the panic bar and connected with the panic door latching mechanism in such a manner that an end wall of the housing abuts one side surface of the lever arm while upper and lower laterally projecting sections of the housing similarly engage the upper and lower surfaces of the arm, and the threaded bolt is secured within the housing in such a manner as to engage the opposite side surface of the lever arm thereby fixedly securing the device upon the panic-bar assembly and positively preventing actuation of the door latching mechanism.

9 Claims, 5 Drawing Figures

ANTI-VANDALISM LOCK DEVICE FOR PANIC-TYPE DOORS

BACKGROUND OF THE INVENTION

1. Field of the Invention

The present invention relates generally to locking devices and more particularly to an improved anti-vandalism locking device which is particularly adaptable for use upon panic-type doors commonly employed within public buildings.

2. Description of the Prior Art

Many buildings, such as for example, large stores, schools, theaters and other public institutions which are frequented by the public in relatively large numbers are commonly equipped with double panic-type doors which are adapted to be opened by pushing downwardly upon horizontally disposed, waist-level cross-bars or panic bars respectively mounted upon the inner surface of the doors, such bars in turn operating conventional door-latch mechanisms. Such doors are also provided with key-operated devices which can also operate the latch mechanisms and in this manner, the doors may be locked from the outside, however, the same may always nevertheless be operated from the inside as a result of the depression of the horizontally extending panic bars toward the interior door surfaces.

Panic-type doors of the aforenoted construction however, have in fact proven vulnerable to vandals and thieves who have apparently discovered the fact that the doors may be opened from the outside of the building and access thereby gained to the building by means of inserting a hooked wire through the narrow vertical opening defined between the double doors, so as to grasp the panic bar and upon pulling the same downwardly, the door latch mechanism may be unlocked in a manner similar to that which is normally employed when exiting from the building. As a result of such unauthorized entrance, institutions have recently been subjected to a substantial amount of vandalism and theft. A need therefore, exists to render such panic-type doors free from unauthorized intrusion in the manner discussed above.

OBJECTS OF THE INVENTION

Accordingly, it is a significant object of the present invention to provide an improved locking device.

Another object of the present invention is to provide an improved locking device which is particularly adaptable for use upon panic-type doors.

Still another object of the present invention is to provide an improved locking device which is particularly adaptable for use upon panic-type doors so as to effectively prevent unauthorized access into the building upon which the panic-type doors are installed.

Yet another object of the present invention is to provide an improved locking device which is particularly adaptable for use upon panic-type doors and which may be easily installed thereon or removed therefrom.

A further object of the present invention is to provide an improved locking device particularly adaptable for use upon panic-type doors which comprises a minimum number of component parts and which are not readily susceptible to breakage.

A still further object of the present invention is to provide an improved locking device particularly adaptable for use upon panic-type doors which is relatively inexpensive to manufacture.

A yet further object of the present invention is to provide an improved locking device which is particularly adaptable for use upon all types of panic-type doors regardless of whether such doors have glass panels or not.

SUMMARY OF THE INVENTION

The foregoing and other objectives are achieved according to the present invention through the provision of a locking device which is particularly adaptable for installation upon panic-type doors and which comprises a substantially C-shaped housing which is adapted to be deposited about the pivotable lever arm associated with the panic door latching mechanism and a substantially vertically disposed bolt threadedly secured within the housing. The housing in turn comprises upper and lower laterally projecting sections integrally connected to each other in a spaced fashion by means of an end wall and when the housing is deposited upon the panic bar assembly, the end wall abuts one side surface of the pivotable lever arm while the upper and lower sections similarly abut the upper and lower surfaces of such arm. The threaded bolt is then secured within the housing upon the opposite side of the lever arm so as to fixedly secure the locking device thereon. Depression of the panic bar in a downward fashion so as to actuate the latching mechanism and thereby open the door is thus positively prevented.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF A PREFERRED EMBODIMENT

Figure 1:
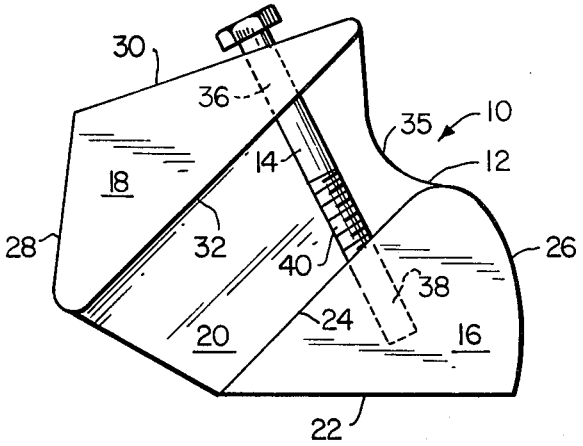
FIG. 1 is an end elevation view of an anti-vandalism lock device constructed according to the present invention and showing its cooperative parts.
Figure 2:
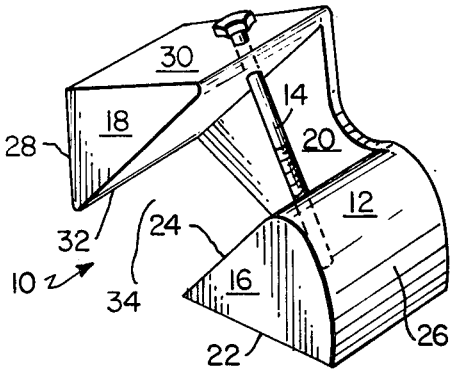
FIG. 2 is a rear, plan-side perspective view of the lock device shown in FIG. 1.
Figure 3:
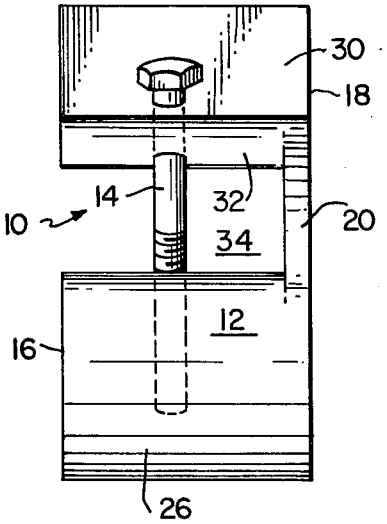
FIG. 3 is a rear-plan perspective view of the lock device shown in FIG. 1.

Referring now to the drawings and more particularly to FIGS. 1–3 thereof, there is shown an anti-vandalism lock device generally indicated by the reference character 10 and comprising a substantially C-shaped rigid housing 12 having disposed therein a threaded bolt 14. The housing 12 is seen to include a first substantially triangular laterally projecting solid lower section 16 and a second substantially triangular laterally projecting solid upper section 18 spaced above and forward of the lower section 16 yet integrally connected thereto by means of a side wall member 20, and the housing may be fabricated of any suitable rigid material, such as for example, wood or metal.

The lower section 16 of housing 12 in turn comprises a horizontally disposed planar base 22, an upwardly, forwardly inclined planar wall 24, and a substantially vertically, arcuately configured front wall 26, the apex connecting walls 24 and 26 also being arcuately configured so as to smoothly join such wall members. Similarly, the upper section 18 of housing 12 comprises a substantially vertical planar rear wall 28, a substantially horizontal planar wall 30 connected to the upper portion of wall 28, and an upwardly, forwardly inclined planar wall 32 which is disposed parallel to wall 24 of lower section 16 so as to define therebetween, along the side wall 20, a chamber or slot 34 which is open upon the side of the device 10 which is disposed opposite side wall 20. It is additionally noted that the forward portion 35 of side wall 20 has a concave configuration, the purpose of which will be made more apparent hereinafter.

The upper housing section 18 is additionally provided with a smooth bore 36 which extends from upper wall surface 30 to inclined wall surface 32 and lower housing section 16 is similarly provided with a threaded bore 38 which extends from inclined wall surface 24 to a predetermined depth within section 16, bores 36 and 38 are aligned with each other so as to cooperatively receive the hexagonal headed bolt 14, the lower portion 40 of which is externally threaded so as to threadedly engage threaded bore 38, and when bolt 14 is assembled within housing 12, the longitudinal axis of the bolt is somewhat rearwardly inclined with respect to a vertical plane.

Figure 4:
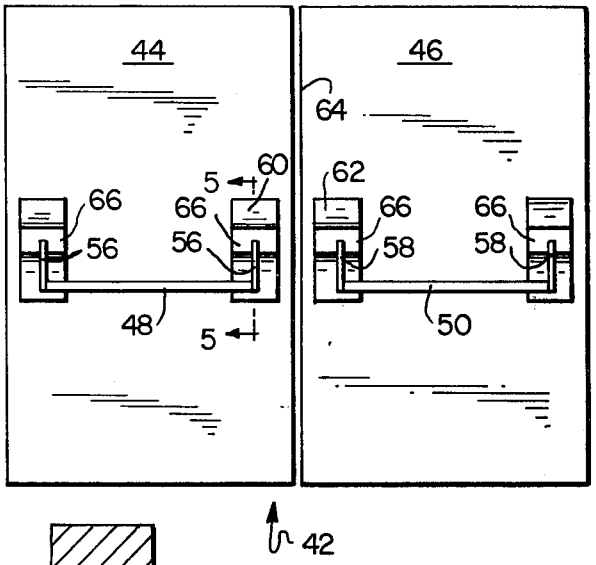
PRIOR ART FIG. 4
FIG. 4 is a front elevation view of a conventional double, panic-type door assembly.

Referring now to FIG. 4, a conventional double, panic-type door assembly, geneally indicated by the reference character 42, is illustrated and is seen to include a left door 44 and a right door 46 each of which is provided with a transversely extending, horizontally disposed panic-bar 48 and 50, respectively. Bars 48 and 50 are pivotally supported upon pivot structures 52, which include pivot pins 54 (see FIG. 5), by means of integrally formed support arms or levers 56 and 58, and the centrally located pivot structures are in turn mounted upon conventional locking assemblies 60 and 62 so as to actuate latching mechanisms, not shown, enclosed therewithin. Levers 56 and 58 and normally inclined downwardly and outwardly from the pivot structures 52 so as to support panic-bars 48 and 50 at positions spaced from the doors 44 and 46, and in a wellknown manner, upon depressing bars 48 and 50 downwardly and toward the doors, the latch mechanisms, not shown, will be actuated so as to permit the doors to be opened. Upon release of the bars 48 and 50, the same are pivotally returned to their normal, non-actuated positions by means of springs, not shown, embodied within the pivot structures 52.

When the doors 44 and 46 are in their closed positions, a small space or opening 64 is defined therebetween and it has been found that vandals and thieves wishing to gain entrance to the building upon which doors 44 and 46 are installed can easily do so by inserting a curved or hooked-shaped wire within space 64 so as to grasp one of the bars 48 or 50 and upon pulling downwardly and toward the doors, the panic-bars may be operated so as to unlock the door latch mechanisms. With the anti-vandalism locking device of the present invention however, an unauthorized entrance as just described is positively thwarted.

Figure 5:
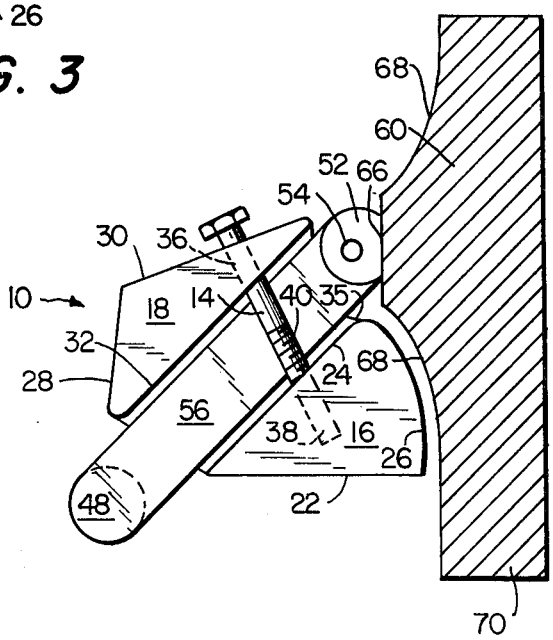
FIG. 5 is a cross-sectional view of the lock device shown in FIG. 1 when assembled upon the door assembly of FIG. 4 as seen along line 5—5 of FIG. 4.

In assembling the locking device 10 with respect to the double panic-type door assembly 42, the device 10 is especially adapted to be mounted upon either of the locking assemblies 60 or 62 and with particular reference now being made to FIG. 5, it will be seen that the conventional assemblies 60 or 62 include forwardly disposed, vertical planar surfaces 66 upon which the pivot structures 52 are mounted and rearwardly extending arcuate surfaces 68 which smoothly integrate surfaces 66 with the residual base portions 70 of assemblies 60 and 62. It will additionally be noted that the curvature of arcuate surface 26 of the lower section 16 of device 10 has been configured so as to match and mate with surface 68 of assembly 60 when the device is mounted upon the assembly 60 and in like manner, the concavity of surface 35 of device 10 is similarly configured so as to match the outer curvature of pivot structure 52.

It will be further appreciated that the surfaces 24 and 32 of the lower and upper sections 16 and 18 of device 10 have also been especially designed, the inclination of such surfaces being fabricated so as to be substantially the same as the inclination of the support lever 56 when the same is disposed within its non-depresssed position, the width of chamber or slot 34 defined between surfaces 24 and 32 being slightly larger than the depth of arm or lever 56 so as to permit accommodation of arm or lever 56 therewithin. In a likewise manner, the bores 36 and 38 have been machined within upper and lower sections at an appropriate distance away from side wall 20 which, as best seen in FIGS. 2 and 3, is slightly larger than the width of arm or lever 56 so as to permit arm or lever 56 to be accommodated between bolt 14 and sidewall 20.

As will then be readily apparent, the locking device 10 of the present invention may thus be easily mounted upon the locking assemblies of the panic-type door assemblies by initially removing the threaded bolt 14 and slipping the C-shpaed housing 12 about the lever arm 56 in such a manner that the laterally projecting housing sections 16 and 18 are disposed toward the central door space 64. In this manner, inclined surface walls 32 and 24 of housing section 18 and 16 substantially abut the upper and lower surfaces of lever arm 56 while the side wall 20 abuts the side surface of arm 56 which is disposed closest to panic bar 48. In addition, arcuate surfaces 26 and 68, as well as 35 and the corresponding surface of pivot structure 52, are mated in a contiguous arrangement, and upon re-inserting bolt 14 within bores 36 and 38, the bolt is likewise contiguous to the other side surface of lever arm 56 which faces the central door space 64.

In this manner, the device 10 is fixedly secured upon the panic-door locking assembly, whereby depression of panic-bar 48 is positively prevented. Consequently, unauthorized access to the building from a position outside thereof cannot be attained as has been previously accomplished heretofore, it being of course appreciated however, that as a result of operating the door latch mechanism by means of the conventional key lock system, authorized access to the building is nevertheless permitted even when the locking device of the present invention is disposed in its installed position. Likewise, if a person within the building desires to exit therefrom and the locking device is already installed upon the door assembly 42, such person need only remove bolt 14 and housing 12, open the door, replace housing 12 and bolt 14, and permit the door to close. The conventional door latch mechanism will automatically lock the door 44 as the locking device 10 has been re-installed, unauthorized access to the building is again prevented.

Thus, it may be seen that the anti-vandalism locking device of the present invention has important advantages over the known prior art structures in that such locking device may be rapidly and easily installed upon panic-type door assemblies so as to positively prevent unauthorized access to the building within which the door assemblies are installed. The device is fixedly secured upon the door locking assemblies so as not to be susceptible of inadvertent removal therefrom, and as such locking devices are secured directly to the locking assemblies as opposed to the door surfaces per se, even if access to the building is attempted during which attempt the panic-bars are broken, the locking device of the present invention will nevertheless remain intact and installed upon locking assembly lever arms. Still further, as the locking devices are not secured to the door surfaces, the devices may be used with glass doors having panic-bar mechanisms installed thereon. Yet further, authorized access into or egress out of the building is nevertheless permitted even when the present invention lockng device is in use.

Obviously, many modifications and variations of the present invention are possible in light of the above teachings. It is to be understood therefore that within the scope of the appended claims, the present invention may be practiced otherwise than as specifically described herein.

What is claimed is:

1. A lock device for use upon a panic-type door assembly which includes a transversely extending panic-bar pivotably supported by means of pivotable lever arms operatively connected in a locking assembly of said door and which is adapted to be depressed downwardly for actuating a locking mechanism disposed within said locking assembly, comprising:

means adapted to be secured to one of said pivotable lever arms and interposed between said one of said pivotable lever arms and said locking assembly of said door for preventing pivotable movement of said one of said pivotable lever arms and consequent actuation of said locking mechanism disposed within said locking assembly of said door as a result of a downward depression of said panic-bar; and fastener means secured within said means for fixedly securing said means upon said one of said pivotable lever arms.

2. A lock device as set forth in claim 1, wherein:

said means comprises a C-shaped housing; and said fastener means comprises a threaded bolt.

3. A lock device as set forth in claim 2, wherein:

said housing comprises spaced upper and lower sections integrally connected by means of a wall member, said upper section having a bore defined therein and said lower section having a threaded bore defined therein which is longitudinally aligned with said bore within said upper section of said housing; and said threaded bolt is adapted to be inserted within said bores so as to be threadedly engaged within said housing.

4. A lock device as set forth in claim 3, wherein:

said space defined between said upper and lower housing sections is slightly larger than the depth of said one of said pivotable lever arms; and said bores defined within said upper and lower housing sections are disposed away from said wall member at a distance slightly larger than the width of said one of said pivotable lever arms, wherein a chamber or slot is defined between said upper and lower housing sections, said wall member, and said bolt for accommodating said one of said pivotable lever arms therewithin.

5. A lock device as set forth in claim 3, wherein:

said upper and lower housing sections are substantially triangular in configuration.

6. A lock device as set forth in claim 3, wherein:

said wall member is a vertical side wall and said upper and lower housing sections project laterally therefrom; and said threaded bolt is substantially vertically disposed, said wall member being disposed upon one side of said one of said pivotable lever arms when said housing is secured thereon while said upper and lower housing sections are disposed above and below said one of said lever arms and said threaded bolt is disposed upon the opposite side of said one of said lever arms from that of said wall member.

7. A lock device as set forth in claim 3, wherein:

each of said upper and lower housing sections includes a planar wall surface, said planar wall surfaces being disposed parallel to each other and inclined with respect to a horizontal plane, said inclination of said surfaces corresponding to the normal inclination of said one of said pivotable lever arms when said one of said lever arms is in its nondepressed state.

8. A lock device as set forth in claim 3, wherein:

said lower housing section includes a substantially vertical, arcuately configured wall member, the curvature of which corresponds to the curvature of a portion of said door locking assembly, whereby said lower housing section may be properly interposed between said one of said lever arms and said locking assembly.

9. A lock device as set forth in claim 3, wherein:

said wall member includes a concave portion, the curvature of which corresponds to the curvature of the pivot structure pivotably securing said one of said lever arms to said door locking assembly.

* * * * *